US010233580B2

(12) United States Patent
Lv et al.

(10) Patent No.: US 10,233,580 B2
(45) Date of Patent: Mar. 19, 2019

(54) FREELY ROTATING WAVE WHEEL HAVING HOUSING CAVITIES

(71) Applicants: HAIER GROUP CORPORATION, Shandong (CN); QINGDAO HAIER WASHING MACHINE CO., LTD., Shandong (CN)

(72) Inventors: Peishi Lv, Shandong (CN); Lin Yang, Shandong (CN); Shunji Imai, Shandong (CN); Lingchen Wang, Shandong (CN); Yunlong Tian, Shandong (CN); Yanni Jiang, Shandong (CN)

(73) Assignee: Haier Group Corporation, Qingdao, Shandong (CN)

( * ) Notice: Subject to any disclaimer, the term of this patent is extended or adjusted under 35 U.S.C. 154(b) by 197 days.

(21) Appl. No.: 15/123,614

(22) PCT Filed: Nov. 28, 2014

(86) PCT No.: PCT/CN2014/092486
§ 371 (c)(1),
(2) Date: Sep. 2, 2016

(87) PCT Pub. No.: WO2015/135341
PCT Pub. Date: Sep. 17, 2015

(65) Prior Publication Data

US 2017/0073868 A1 Mar. 16, 2017

(30) Foreign Application Priority Data

Mar. 11, 2014 (CN) ..... 2014 1 0088320

(51) Int. Cl.
*B08B 3/02* (2006.01)
*D06F 17/10* (2006.01)

(52) U.S. Cl.
CPC ..... *D06F 17/10* (2013.01)

(58) Field of Classification Search
CPC ..... B08B 3/024
See application file for complete search history.

(56) References Cited

U.S. PATENT DOCUMENTS

| | | | | |
|---|---|---|---|---|
| 5,727,403 | A | 3/1998 | Na | |
| 2009/0293203 | A1 | 12/2009 | Hettinger et al. | |
| 2012/0144877 | A1* | 6/2012 | Byrne | D06F 37/40 68/134 |

FOREIGN PATENT DOCUMENTS

| | | | |
|---|---|---|---|
| CN | 101629371 | A | 1/2010 |
| CN | 201530928 | U | 7/2010 |

(Continued)

OTHER PUBLICATIONS

International Search Report dated Feb. 15, 2015 from International Patent Application No. PCT/CN2014/092486 filed Nov. 28, 2014.

(Continued)

*Primary Examiner* — Jason Y Ko
(74) *Attorney, Agent, or Firm* — David B. Tingey; Bryant J. Keller; Kirton McConkie

(57) ABSTRACT

The present disclosure discloses a freely rotating wave wheel having a housing cavity. The freely rotating wave wheel includes an impeller; an impeller rotating shaft is connected to the impeller; a freely rotatable impeller rotating wheel is installed on the impeller rotating shaft; and a housing cavity is arranged inside the impeller rotating wheel, and/or between the impeller rotating wheel and the impeller, and/or between the impeller rotating shaft and the impeller. Antibacterial and disinfectant substances or other substances beneficial to washing effects of clothes can be arranged in the housing cavity. When water enters into the washing machine to wash and rinse clothes, antibacterial and disinfectant substances or other substances beneficial to (Continued)

washing effects of clothes can effectively perform effects to purify water quality and prevent cross infection due to mixed washing of clothes, thereby generating a better washing effect.

14 Claims, 5 Drawing Sheets

(56) References Cited

FOREIGN PATENT DOCUMENTS

| | | | |
|---|---|---|---|
| CN | 103046292 | A | 4/2013 |
| CN | 203144741 | U | 8/2013 |
| JP | 57183893 | A | 11/1982 |
| JP | 6422286 | A | 1/1989 |
| JP | 1071290 | A | 3/1998 |

OTHER PUBLICATIONS

European Search Report dated Oct. 20, 2017 from European Patent Application No. 14885698.2 filed Jan. 18, 2017.

* cited by examiner

FREELY ROTATING WAVE WHEEL HAVING HOUSING CAVITIES

CROSS REFERENCE TO RELATED APPLICATION

This application is a National Stage of International Patent Application No. PCT/CN2014/092486 filed on Nov. 28, 2014, which claims the benefit of Chinese Patent Application No. 201410088320.7, filed on Mar. 11, 2014, the disclosures of which are hereby incorporated entirely herein by reference.

TECHNICAL FIELD

The present disclosure relates to the field of washing machines, and particularly relates to a freely rotating wave wheel having a housing cavity.

TECHNICAL BACKGROUND

Nowadays, washing machines have become indispensable household appliances in people's daily life. Based on different washing modes, existing washing machines are classified into two types: impeller washing machines and drum washing machines; the impeller washing machine has been widely applied for its simple structure, convenient maintenance and high cleaning rate. However, water flows generated by an impeller of an existing impeller washing machine generally only flow in a same plane, and are difficult to flow in a three-dimensional way, so it is difficult to wash clothes in a way of roll-over and clothes cannot be cleaned uniformly. In addition, bacteria will breed inside the washing machine due to pollution after using for a period of time, so that clothes will suffer secondary pollution. This problem is solved by adding a special device (similar to a detergent throwing box) used for throwing antibacterial and disinfectant substances in the existing impeller washing machine, but these substances are difficult to fully and uniformly contact washing water due to position limitation for containing the antibacterial and disinfectant substances in this manner, therefore the effect is not satisfactory.

There is a Chinese patent of utility model No. 201320129636.7 currently. The utility model provides a fountain type double-impeller washing machine and a fountain type impeller washing machine. The fountain type double-impeller washing machine includes a driving impeller and further includes a driven impeller; a plurality of arc-shaped water tanks are arranged on a lower surface of the driving impeller; a baffle is covered on the arc-shaped water tanks; the arc-shaped water tanks and the baffle form an arc-shaped water passage; water outlets are arranged in an upper end part of the driving impeller; the arc-shaped water passage is communicated with the water outlets; the driven impeller and the driving impeller are coaxially arranged; and the driven impeller is connected with an upper surface of the driving impeller in a sliding way. By connecting the driven impeller to the driving impeller in a sliding way, the driving impeller can drive the driven impeller to differentially rotate by means of water flows; when the driving impeller rotates reversely, the driving impeller and the driven impeller have opposite rotating directions, so as to generate rubbing forces on clothes, thereby increasing cleaning ratio of washings; and when the driving impeller rotates along a curved direction of the arc-shaped water passage, water enters the arc-shaped water passage and sprays out through the water outlets to form fountain type water flows, thereby realizing washing by three-dimensional water flows and is more beneficial for increasing cleaning ratio of the washings.

The above patent clearly gives a technical solution for solving the problem that it is hard for an impeller washing machine to realize three-dimensional flow of water flows, and realizes a technical effect of washing by three-dimensional water flows, but a structure of the lower surface of the impeller of the washing machine is reconfigured in the above patent, so as to form a new water passage which has a relatively complicated structure and fails to solve the technical problem in antibacterium and disinfection of the washing machine.

SUMMARY

The purpose of the present disclosure is to provide a freely rotating wave wheel, so as to enhance washing effect, improve water cleanliness, and achieve a satisfactory washing effect; and meanwhile, the freely rotating wave wheel can have a better washing effect.

To achieve the above purpose, the present disclosure adopts following technical solutions.

A freely rotating wave wheel having a housing cavity, including an impeller; an impeller rotating shaft is connected to the impeller; a freely rotatable impeller rotating wheel is installed on the impeller rotating shaft; and a housing cavity is arranged inside the impeller rotating wheel, and/or between the impeller rotating wheel and the impeller, and/or between the impeller rotating shaft and the impeller.

Further, the impeller rotating shaft includes a base and a main shaft fixed on the base; the base is installed on the impeller; the main shaft is rotatably connected with the impeller rotating wheel; and the housing cavity is arranged between the impeller rotating wheel and the impeller and/or between the base and the impeller.

Further, a groove is formed in center of the impeller; the base of the impeller rotating shaft is installed in the groove; and a cavity among the groove, and the impeller rotating wheel and/or the base forms a housing cavity.

Further, a lug boss structure is arranged inside the groove; the base of the impeller rotating shaft is fixedly installed on the lug boss structure; the groove is divided into a plurality of housing cavities by the lug boss structure; and limiting ribs are arranged on the base corresponding to the housing cavities.

Further, the lug boss structure has a crossed shape; the groove is divided into four symmetrical housing cavities by the lug boss structure; and a fixed installation seat is arranged on bottom of each housing cavity. Further, water inlets are arranged in the impeller; the water inlets are arranged at an installation position of the impeller rotating wheel; and washing water can enter an internal part of the impeller rotating wheel through the water inlets.

Further, the freely rotating wave wheel having the housing cavity further includes an impeller hood and an impeller cover; the impeller hood is covered on an external surface of the impeller rotating wheel; and the impeller cover is detachably covered on an upper opening of the impeller rotating wheel.

Further, both the impeller hood and the impeller cover are made of stainless steel; the impeller rotating wheel is made of plastic material; and the impeller hood and the impeller rotating wheel are integrally manufactured.

Further, a series of convex blocks for rubbing clothes and water outlet holes for generating fountain-shaped water flows are regularly arranged correspondingly on external surfaces of the impeller rotating wheel and the impeller hood.

Further, clips are arranged in an upper opening of the impeller rotating wheel; a clamping groove is arranged in an inner wall of the impeller cover; and the clips are matched and connected with the clamping groove.

The present disclosure adopts technical solutions different from previous solutions; a freely rotatable impeller rotating wheel is connected to the impeller of the washing machine; when the washing machine washes clothes, the impeller rotates to drive water flows to rotate positively and negatively; the impeller rotating wheel freely rotates under effects of the water flows, so as to reduce twining of clothes, protect clothes, and enhance washing effects of clothes; water outlet holes are arranged in the external surface of the impeller rotating wheel; the water outlet holes can generate fountain-shaped water flows, so as to enhance the water flows, quickly dissolve laundry detergents, and further enhance washing effects of clothes; and a housing cavity capable of containing antibacterial and disinfectant substances is arranged in the impeller rotating wheel and/or between the impeller rotating shaft and the impeller, so that the antibacterial and disinfectant substances are thoroughly mixed in washing water and antibacterial and disinfectant effects are better.

From the above, the present disclosure has advantages as follows.

1. The housing cavity is arranged inside the impeller rotating wheel and/or between the impeller rotating shaft and the impeller in the present disclosure; antibacterial and disinfectant substances are arranged in the housing cavity; and when water enters into the washing machine to wash and rinse clothes, the antibacterial and disinfectant substances can effectively perform effects of sterilization, so as to purify water quality and prevent cross infection due to mixed washing of clothes.

2. The freely rotatable impeller rotating wheel of the present disclosure is installed on an existing impeller, so as to reduce twining of clothes, protect clothes, and enhance washing effects of clothes.

3. A series of convex blocks are arranged on the external surface of the impeller rotating wheel of the present disclosure, so as to effectively increase rubbing effects on clothes and generate a better washing effect.

4. The water outlet holes are arranged in the external surface of the impeller rotating wheel of the present disclosure; the water outlet holes can generate fountain-shaped water flows, so as to enhance water flows, quickly dissolve laundry detergents, and further enhance washing effects of clothes.

5. The impeller hood and the impeller cover on the external surface of the impeller rotating wheel of the present disclosure are made of stainless steel material; and the material is smooth and wear-proof and has no wear to clothes.

A LIST OF REFERENCE NUMERALS

Figure 1:
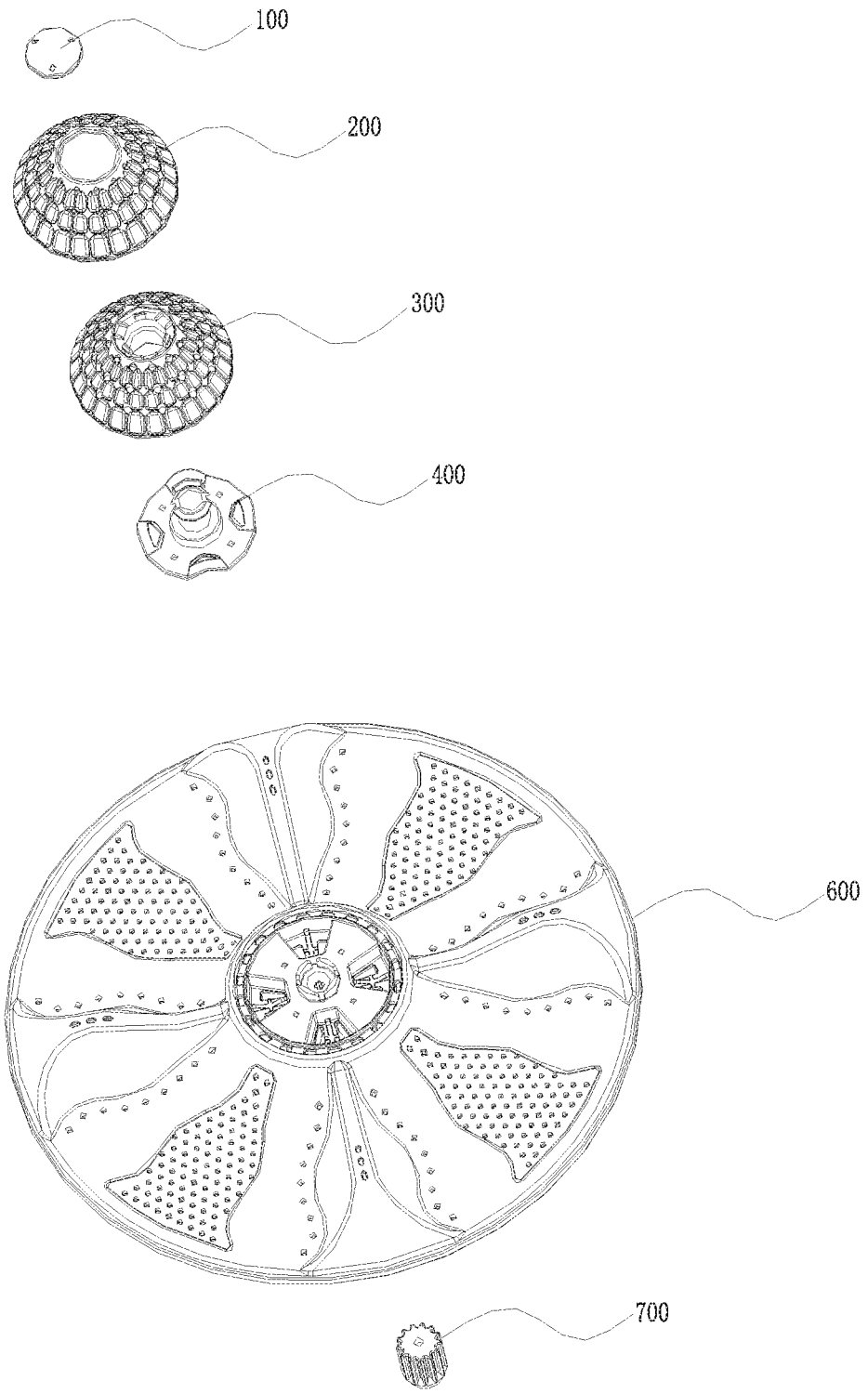
FIG. 1 is an exploded diagram of the present disclosure.
Figure 2:
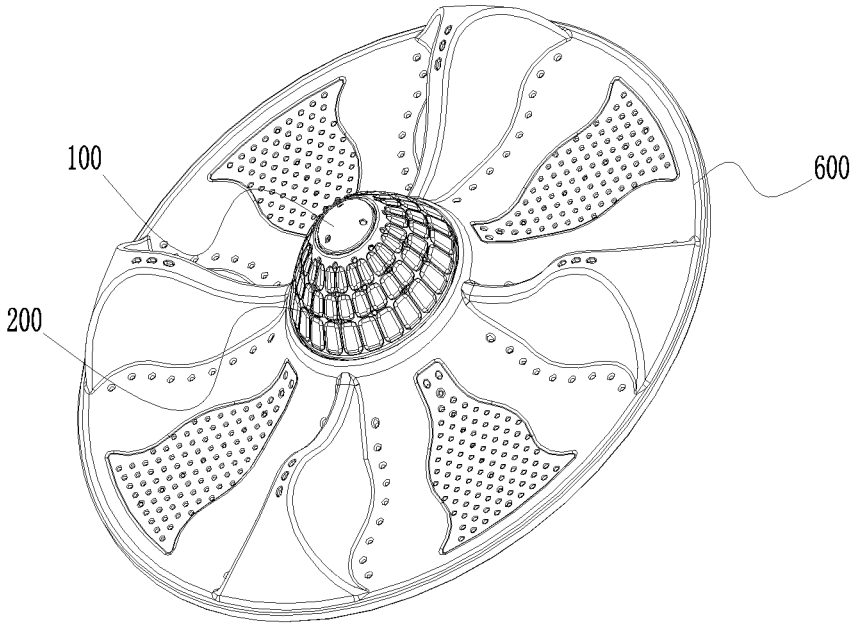
FIG. 2 is a stereoscopic structural diagram of the present disclosure.
Figure 3:
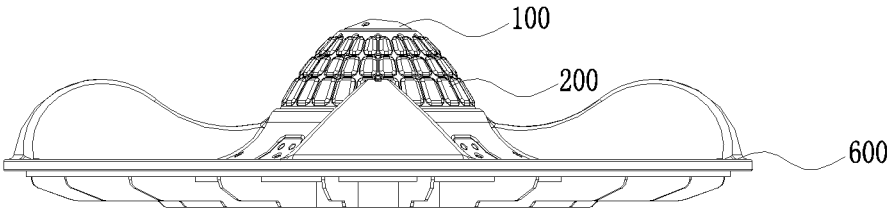
FIG. 3 is a main view of the present disclosure.
Figure 4:
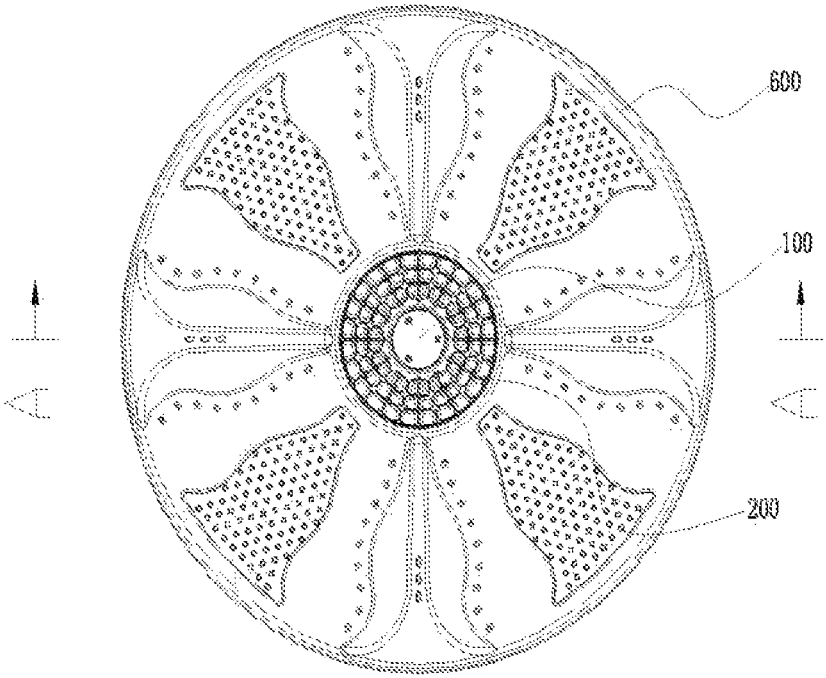
FIG. 4 is a top view of the present disclosure.
Figure 5:
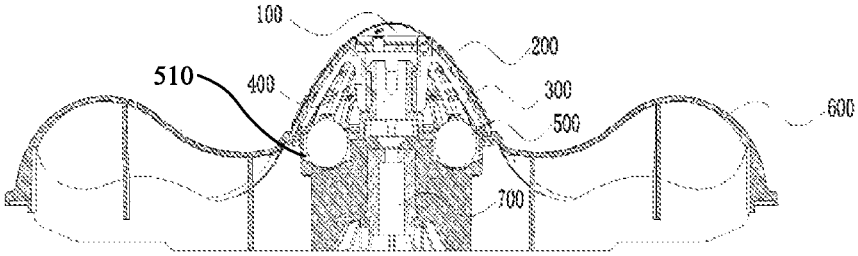
FIG. 5 is a sectional view of along the A-A side in FIG. 4 in the present disclosure.

100: Impeller cover; 200: Impeller hood; 300: Impeller rotating wheel; 310: Convex block; 320: Water outlet hole; 400: Impeller rotating shaft; 410: Base; 420: Main shaft; 430: Limiting rib; 500: Antibacterial and disinfectant substance; 600: Impeller; 610: Groove; 620: Water inlet; 630: Lug boss structure; 640: Installation port; 700: Impeller lining.

DETAILED DESCRIPTION

The freely rotating wave wheel having the housing cavity in the present disclosure is detailed below in combination with drawings:

As shown in FIGS. 1-5, a freely rotating wave wheel having a housing cavity includes an impeller 600; an impeller rotating shaft 400 is connected to the impeller 600; a freely rotatable impeller rotating wheel 300 is installed on the impeller rotating shaft 400; and a housing cavity is arranged inside the impeller rotating wheel 300, and/or between the impeller rotating wheel 300 and the impeller 600, and/or between the impeller rotating shaft 400 and the impeller 600.

The housing cavity is arranged inside the impeller rotating wheel and/or between the impeller rotating shaft and the impeller in the present disclosure; antibacterial and disinfectant substances can be arranged in the housing cavity; and when water enters into the washing machine to wash and rinse clothes, antibacterial and disinfectant substances can effectively perform sterilization effects, so as to purify water quality and prevent cross infection due to mixed washing of clothes. Other substances beneficial to washing effect of clothes can also be arranged in the housing cavity, such as substances for eliminating abnormal tastes of clothes, substances for avoiding discoloring clothes and other related substances; and by configuring these substances, a better washing effect is obtained on clothes and a user has better use experience. The present disclosure is specifically described by configuring antibacterial and disinfectant substances as an example.

Regardless of assembly manners of the impeller 600 of the impeller rotating shaft 400 of the present disclosure, a first housing cavity 510 can be arranged inside the impeller rotating wheel 300; however, when the impeller 600 of the impeller rotating shaft 400 is integrally manufactured, the housing cavity can also be arranged between the impeller rotating wheel 300 and the impeller 600; however, when the impeller 600 of the impeller rotating shaft 400 is assembled and installed, the housing cavity can be arranged between the impeller rotating shaft 400 and the impeller 600. The above housing cavity is in a preferred arrangement manner; the arrangement manner of the housing cavity is not limited to the above three situations; that is, when the impeller 600 of the impeller rotating shaft 400 is integrally manufactured, the housing cavity can be arranged between the impeller rotating shaft 400 and the impeller 600; and when the impeller 600 of the impeller rotating shaft 400 is assembled and installed, the housing cavity can also be arranged between the impeller rotating wheel 300 and the impeller 600.

The housing cavity is creatively arranged at bottom of an inner drum of the washing machine in the present disclosure; and antibacterial and disinfectant substances are thoroughly mixed in washing water through continuous effect of the water flows, so as to obtain better antibacterial and disinfectant effects. Specifically, the housing cavity of the present disclosure can be arranged inside the freely rotatable impeller rotating wheel or on the impeller of the washing machine; when the housing cavity is arranged inside the impeller rotating wheel, attention is paid to that the housing cavity should not be designed to be too large, so as to avoid increasing of volume of the impeller rotating wheel or influencing free rotation of the impeller rotating wheel; and meanwhile, the housing cavity should be communicated with water outlet holes in the impeller rotating wheel, so that water flows entered into the housing cavity are drained out after contacting antibacterial and disinfectant substances, so as to perform effects of antibacterium and disinfection.

Figure 7:
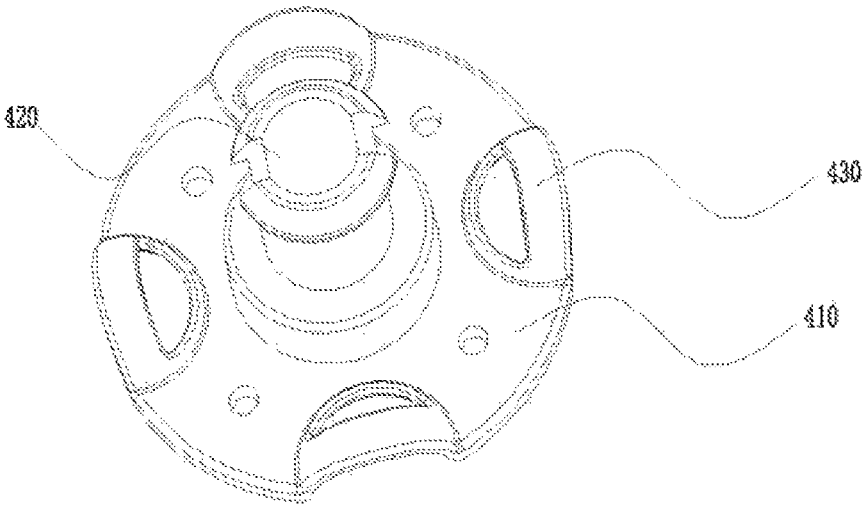
FIG. 7 is a schematic structural diagram illustrating a impeller rotating shaft of the present disclosure.

The present disclosure also provides a preferred embodiment of installing the housing cavity on the impeller of the washing machine. Specifically, as shown in FIG. 7, the impeller rotating shaft 400 of the present disclosure includes a base 410 and a main shaft 420 fixed on the base 410; the base 410 is installed on the impeller 600; the main shaft 420 is rotatably connected with the impeller rotating wheel 300; and second housing cavities 520 are arranged between the base 410 and the impeller 600.

To realize free rotation of the impeller rotating wheel 300 installed on the impeller rotating shaft 400 of the present disclosure, the impeller rotating wheel 300 is sleeved on the main shaft 420; after the impeller rotating wheel 300 is sleeved on the main shaft 420, in order to prevent the impeller rotating wheel 300 from falling out, a limiting mechanism is arranged on the top of the main shaft 420. A diameter of an upper shaft end of the main shaft 420 of the present disclosure is greater than a diameter of a shaft section on which the impeller rotating wheel 300 is sleeved on an lower part. Correspondingly, two sections of installation holes with different sizes are arranged inside the impeller rotating wheel; diameters of upper installation holes are greater than those of lower installation holes; the lower installation holes are sleeved on the main shaft 420; and a limiting shaft end on top of the main shaft 420 is clamped by stairs between the upper installation holes and the lower installation holes. Meanwhile, for convenience of installation of the impeller rotating wheel 300, two opposite notches are formed in an upper shaft end of the main shaft 420, and a width between the two notches is equal to a diameter of a shaft section on which the impeller rotating wheel 300 is sleeved.

Figure 6:
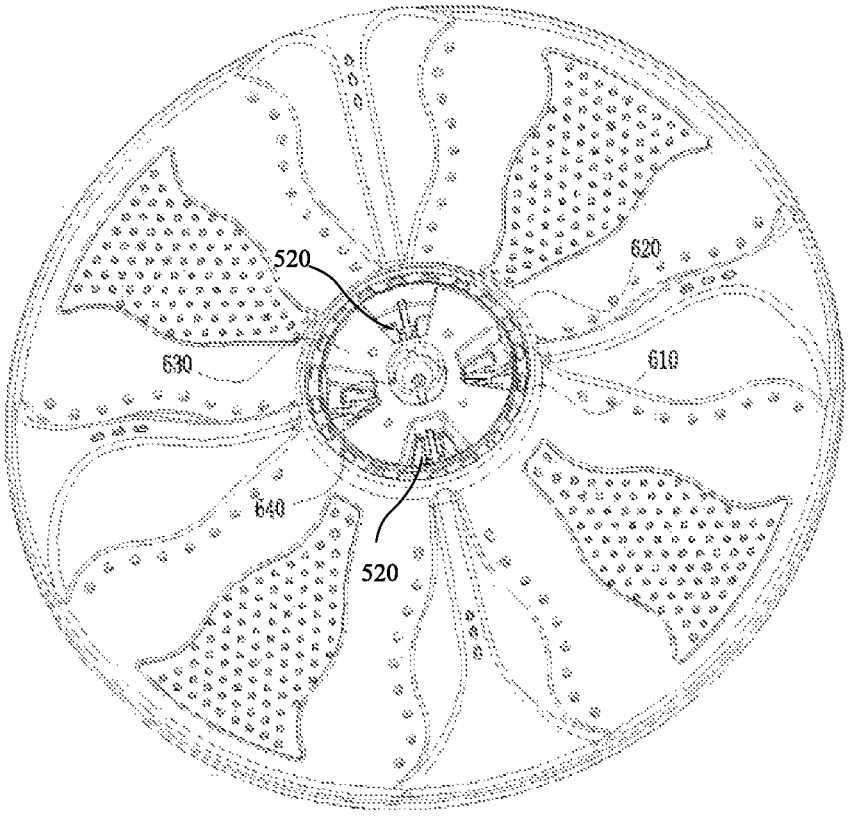
FIG. 6 is a schematic structural diagram illustrating an impeller of the present disclosure.

As shown in FIG. 6, in order to match with the impeller rotating shaft 400 of the present disclosure, a groove 610 is formed in center of the impeller 600 of the present disclosure. Specifically, the groove 610 of the present disclosure is configured to be circular; the base 410 of the impeller rotating shaft 400 is installed in the groove 610; and a cavity between the groove 610 and the base 410 forms a housing cavity.

The present disclosure provides a specific installation manner for the impeller rotating shaft 400 and the impeller 600. A lug boss structure 630 is arranged inside the groove 610; the base 410 of the impeller rotating shaft 400 is fixedly installed on the lug boss structure 630; and the groove 610 is divided into a plurality of housing cavities by the lug boss structure 630. Specifically, the lug boss structure 630 of the present disclosure has a crossed shape; an installation port 640 for installing the impeller rotating shaft 400 is arranged in center of the lug boss structure 630; the groove 610 is divided into four spaces by the lug boss structure 630 to form housing cavities; a fixed installation seat is arranged on bottom of each housing cavity; and the fixed installation seat is an elastic gasket and can be correspondingly adjusted elastically according to different substances arranged in the housing cavities, so as to ensure fixing stability. Accordingly, the base 410 of the impeller rotating wheel 400 of the present disclosure also presents a crossed shape; after a crossing of the base 410 is matched with a crossing of the lug boss structure 630, the base 410 and the lug boss structure 630 are fixedly connected through screws. For sealing of the housing cavities, limiting ribs 430 are arranged on the base 410 corresponding to the housing cavities, i.e., two adjacent crossed walls are connected to form the limiting rib 430.

Antibacterial and disinfectant substances can be arranged inside the housing cavities of the present disclosure; antibacterial and disinfectant substances 500 are solid bactericidal substances with certain regular shapes, and specifically can be configured to be spherical, ellipsoidal, rectangular and the like; and volume of the solid bactericidal substances is matched with volume of the housing cavities therein, i.e., one antibacterial and disinfectant substance 500 is arranged in one housing cavity.

Optionally, the antibacterial and disinfectant substances 500 adopted in the present disclosure are silver ion antibacterial balls; an antibacterial functional mechanism of silver ions includes several aspects as follows: 1. interference with synthesis of a cell wall; 2. damage to a cell membrane, where the cell membrane is an important part of vital movement of bacterial cells; 3. inhibition of synthesis of protein; and 4. interference with synthesis of nucleic acid. Because silver has an adsorptive action on a microorganism in liquid, after the microorganism is absorbed by the silver, respiration enzymes lose efficacy and the microorganism would die rapidly. The silver ion has an especially strong bactericidal capability; and as long as each liter of water contains two mg of hundreds of millions of silver ions, most of bacteria in water can be killed. Therefore, by adopting the silver ion antibacterial balls as the antibacterial and disinfectant substances 500, the present disclosure has advantages that not only antibacterial and disinfectant effects are good, but also substances are safe to the user, a use period is long, and the like.

Because silver ion antibacterial balls are adopted as the antibacterial and disinfectant substances 500 of the present disclosure, to maintain stability of the silver ion antibacterial balls in the housing cavities, a bottom frame in a crossed shape is arranged at bottom of each housing cavity so as to contain silver ion antibacterial balls; meanwhile, the limiting ribs 430 arranged on the base 420 of the impeller rotating shaft 400 bends upwards by a certain radian, so as to adapt to the spherical silver ion antibacterial balls; and meanwhile, water outlets are arranged between the limiting ribs 430 and the base 420. In this way, water flows can enter the housing cavities and then wash the silver ion antibacterial balls; so that silver ions flow out of the housing cavities via the water outlets between the limiting ribs 430 and the base 420 along with the water flows, to reach an inner part of the impeller rotating wheel 300; and then fountain-shaped water flows are formed through the water outlet holes 320 formed in the impeller rotating wheel 300 and return to an inner drum of the washing machine. Such a process is continuously circulated while washing clothes by the washing machine, so that washing water uniformly contains enough silver ions, so as to realize antibacterial and disinfectant effects. Compared with the existing washing machine that antibacterial and disinfectant substances are arranged on a side wall of an inner drum, the present disclosure can mix antibacterial and disinfectant substances with washing water more uniformly and more thoroughly and has better antibacterial and disinfectant effects.

To enable water flows to enter into the housing cavities, water inlets 610 are arranged in the impeller 600 of the present disclosure; the water inlets 610 are arranged at an installation position of the impeller rotating wheel 300; and washing water can enter into an internal part of the impeller rotating wheel 300 through the water inlets 610. Specifically, as shown in FIG. 6, a series of water inlets 620 are arranged uniformly around the circular groove 610; the water inlets 620 are communicated with an internal part of the groove 610; and all housing cavities in the groove can be filled with washing water through the water inlets 620.

Figure 8:
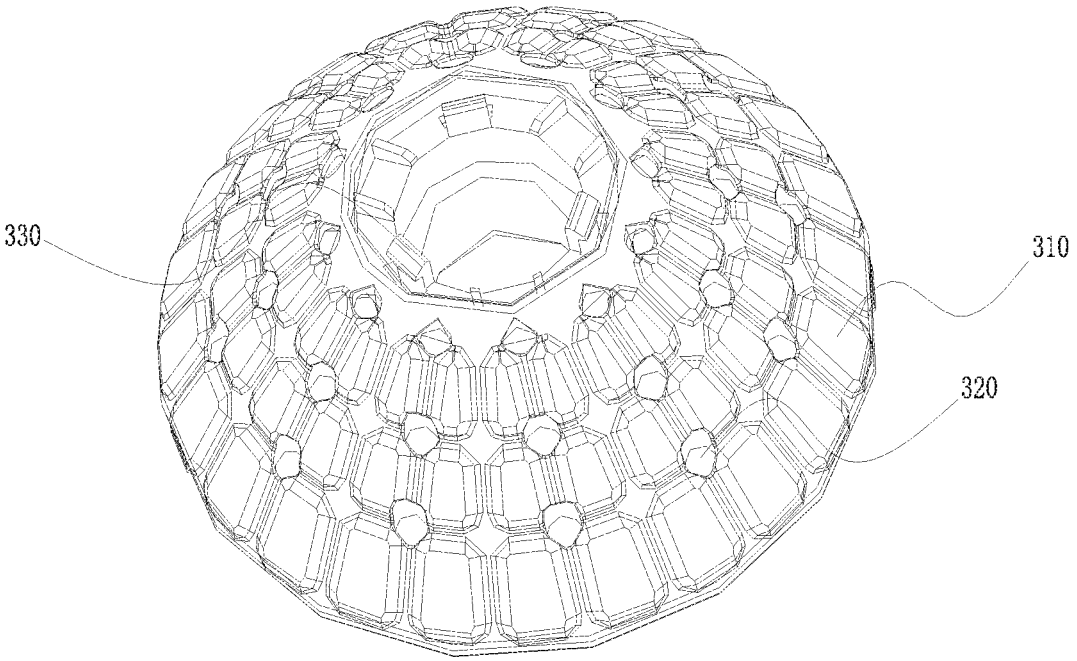
FIG. 8 is a schematic structural diagram illustrating an impeller rotating wheel of the present disclosure.

As shown in FIG. 1 and FIG. 8, the freely rotating wave wheel having the housing cavity in the present disclosure further includes an impeller hood 200 and an impeller cover 100; the impeller hood 200 is covered on an external surface of the impeller rotating wheel 300; and the impeller cover 100 is detachably covered on an upper opening of the impeller rotating wheel 300.

Both the impeller hood 200 and the impeller cover 100 in the present disclosure are made of stainless steel, and specifically, can be made of SUS304 BA material. Because the stainless steel material is adopted, a whole external surface of the impeller rotating wheel 300 is smooth and wear-proof and has no wear to clothes. The impeller rotating wheel 300 is made of plastic material; and the impeller hood 200 and the impeller rotating wheel 300 are integrally manufactured. The impeller rotating wheel 300 is made of plastic material; firstly, integral mass of the impeller rotating wheel 300 is greatly reduced; inertial forces are decreased, so that free rotation is more facilitated; secondly, a manufacturing process can be greatly simplified by adopting the plastic material; and finally, installation and disassembly are convenient and cost is reduced. A series of convex blocks 310 for rubbing clothes and water outlet holes 320 for generating fountain-shaped water flows are regularly arranged correspondingly on external surfaces of the impeller rotating wheel 300 and the impeller hood 200 in the present disclosure.

Clips 330 are arranged in an upper opening of the impeller rotating wheel 300 of the present disclosure; a clamping groove is arranged in an inner wall of the impeller cover 100; and the clips 330 are matched and connected with the clamping groove. Optionally, three clips 330 are arranged and are uniformly distributed in the upper opening of the impeller rotating wheel 300.

The above only describes embodiments of the present disclosure, not intended to limit the present disclosure in any form. Although the present disclosure is disclosed as above by embodiments, the embodiments are not used for limiting the present disclosure. Any of those skilled knowing the patent can make little change or modify them into equivalent embodiments with equivalent variation based on the above prompted technical content without departing from the scope of the technical solution of the present disclosure. However, any simple change, equivalent variation and modification made to the above embodiments based on the technical essence of the present disclosure without departing from the content of the technical solution of the present disclosure should still belong to the scope of the solution of the present disclosure.

What is claimed is:

1. A freely rotating wave wheel having housing cavities, comprising:

an impeller;

an impeller rotating shaft connected to the impeller;

a freely rotatable impeller rotating wheel installed on the impeller rotating shaft; a first housing cavity arranged inside the impeller rotating wheel; and an impeller hood and an impeller cover, wherein an external surface of the impeller rotating wheel is covered by the impeller hood, and the impeller cover is configured for detachably covering an upper opening of the impeller rotating wheel.

2. The freely rotating wave wheel having the housing cavities according to claim 1, wherein the impeller rotating shaft comprises a base and a main shaft fixed on the base; the base is installed on the impeller; the main shaft is rotatably connected with the impeller rotating wheel; and second housing cavities are arranged between the base and the impeller.

3. The freely rotating wave wheel having the housing cavities according to claim 2, wherein a groove is formed in center of the impeller; the base of the impeller rotating shaft is installed in the groove; and a cavity between the groove and the base forms the second housing cavities.

4. The freely rotating wave wheel having the housing cavities according to claim 3, wherein a lug boss structure is arranged inside the groove; the base of the impeller rotating shaft is fixedly installed on the lug boss structure; the groove is divided into the second housing cavities by the lug boss structure; and a limiting rib is arranged at a position on the base corresponding to a respective one of the second housing cavities.

5. The freely rotating wave wheel having the housing cavities according to claim 4, wherein the lug boss structure has a crossed shape; the groove is divided into four symmetrical second housing cavities by the lug boss structure; and a fixed installation seat is arranged on a bottom of the respective one of the second housing cavities.

6. The freely rotating wave wheel having the housing cavities according to claim 1, wherein water inlets are arranged in the impeller; the water inlets are arranged at an installation position of the impeller rotating wheel; and washing water can enter an internal part of the impeller rotating wheel through the water inlets.

7. The freely rotating wave wheel having the housing cavities according to claim 1, wherein both the impeller hood and the impeller cover are made of stainless steel; the impeller rotating wheel is made of plastic material; and the impeller hood is formed integrally with the impeller rotating wheel.

8. The freely rotating wave wheel having the housing cavities according to claim 1, wherein a series of convex blocks for rubbing clothes and water outlet holes for generating fountain-shaped water flows are regularly arranged on external surfaces of the impeller rotating wheel and the impeller hood.

9. The freely rotating wave wheel having the housing cavities according to claim 1, wherein clips are arranged in an upper opening of the impeller rotating wheel; a clamping groove is arranged in an inner wall of the impeller cover; and the clips are fitted with the clamping groove.

10. The freely rotating wave wheel having the housing cavities according to claim 2, wherein both the impeller hood and the impeller cover are made of stainless steel; the impeller rotating wheel is made of plastic material; and the impeller hood is formed integrally with the impeller rotating wheel.

11. The freely rotating wave wheel having the housing cavities according to claim 3, wherein both the impeller hood and the impeller cover are made of stainless steel; the impeller rotating wheel is made of plastic material; and the impeller hood is formed integrally with the impeller rotating wheel.

12. The freely rotating wave wheel having the housing cavities according to claim 2, wherein a series of convex blocks for rubbing clothes and water outlet holes for generating fountain-shaped water flows are regularly arranged on external surfaces of the impeller rotating wheel and the impeller hood.

13. The freely rotating wave wheel having the housing cavities according to claim 3, wherein a series of convex blocks for rubbing clothes and water outlet holes for generating fountain-shaped water flows are regularly arranged on external surfaces of the impeller rotating wheel and the impeller hood.

14. The freely rotating wave wheel having the housing cavities according to claim 2, wherein clips are arranged in an upper opening of the impeller rotating wheel; a clamping groove is arranged in an inner wall of the impeller cover; and the clips are fitted connected with the clamping groove.

* * * * *